US005189336A

United States Patent [19]

Sarracco

[11] Patent Number: 5,189,336

[45] Date of Patent: Feb. 23, 1993

[54] DEVICE FOR ELECTRON BEAM CONTROL IN A CATHODE RAY TUBE

[75] Inventor: Luigi Sarracco, Rome, Italy

[73] Assignee: Videocolor S.p.A., Anagni, Italy

[21] Appl. No.: 798,446

[22] Filed: Nov. 26, 1991

[30] Foreign Application Priority Data

Jan. 29, 1991 [IT] Italy ..... M191A00208

[51] Int. Cl.[5] ..... H01J 29/76

[52] U.S. Cl. ..... 313/440; 313/412; 335/210

[58] Field of Search ..... 313/440, 412; 335/284, 335/210

[56] References Cited

U.S. PATENT DOCUMENTS 4,138,628 2/1979 Smith ..... 335/210 X
4,162,470 7/1979 Smith .
4,641,062 2/1987 Pons .
5,117,151 5/1992 Sluyterman et al. ..... 313/440 X

OTHER PUBLICATIONS

"Fixture for Magnetic Sheath Magnetizing Unit", by D. L. Dodds, RCA Technical Notes, TN No. 1225, Apr. 1979, Sheets 1 and 2.

*Primary Examiner*—Palmer C. DeMeo
*Attorney, Agent, or Firm*—Joseph S. Tripoli; Joseph J. Laks; Davenport, Francis A.

[57] ABSTRACT

This invention enables the control of the electron beam position within a picture tube. Control is achieved by the use of a magnetized strip which is formed into a ring around the neck and secured by an adhesive film. In one implementation of this invention the strip has at least one end tapered in thickness for preventing an increase in thickness at the ring overlap. The strip ends are overlapped to provide a continuous ring of magnetic medium for optimum control capability.

8 Claims, 4 Drawing Sheets

FIG. 1
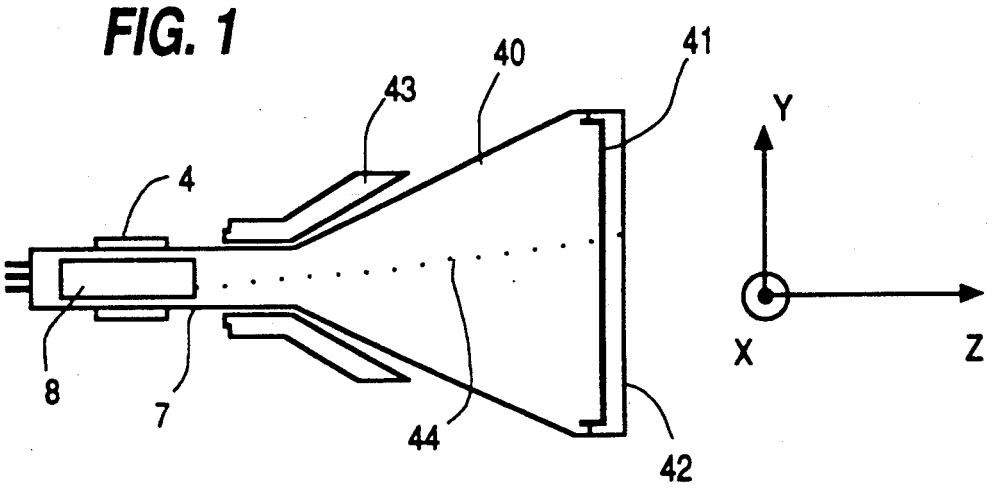
FIG. 2A
PRIOR ART
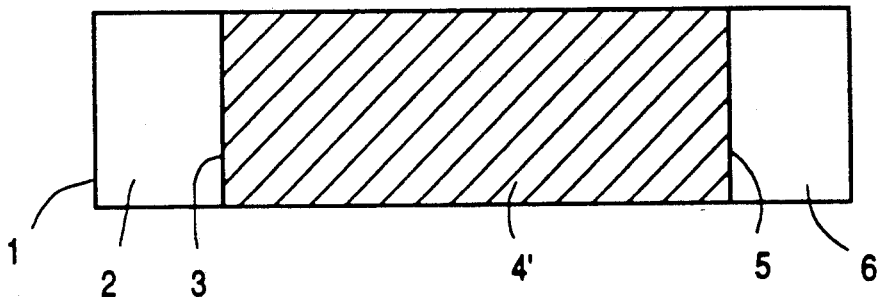
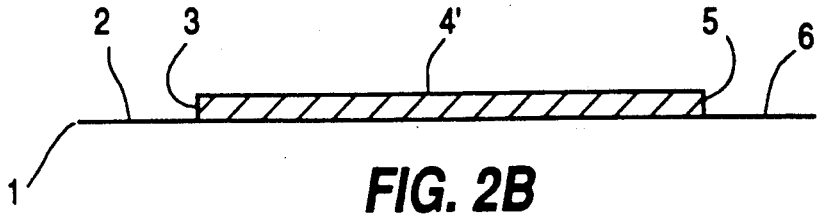
FIG. 2B
PRIOR ART

DEVICE FOR ELECTRON BEAM CONTROL IN A CATHODE RAY TUBE

FIELD OF THE INVENTION

This invention relates to the control of electron beam for adjustment of, for example, static convergence and/or purity in a picture tube.

BACKGROUND OF THE INVENTION

In the in line gun color tube three electron beams are emitted and accelerated towards a screen coated in groups of red green and blue phosphors. The phosphor groups are deposited on the screen in alignment with a perforated metal mask located close to the screen.

Since the electron guns are in the same plane, with the center gun on the tube axis, and providing they are not subjected to any external deflecting field, the electron beams will coincide at the screen center, creating static convergence.

However, the electron beams are intercepted by the perforated metal mask, such that each gun's electron beam can hit a single colored phosphor and as a consequence create good color purity.

There are inherent problems when the electron beam is deflected in color picture tubes which make make it necessary to adjust both electronic beam convergence and color purity.

U.S. Pat. Nos. 4,162,470 and 4,641,062 indicated that these adjustments can be made by inducing permanent magnetization inside a strip wrapped around the tube neck. The strip can be composed, for example, of a powdered magnetizable material dispersed in a plastic binder material. This plastic binder is attached to an adhesive film surface which also provides attachment to the tube neck.

The prior art states that the strip is magnetized in place to control static convergence and purity. This magnetization is performed by a device placed in contact with the strip. However, this method has two disadvantages:

when the strip is wrapped around the neck, the last section of magnetizable strip is prevented from making contact with the neck by the adhesive tape, which, to complete encirclement overlaps the start of the magnetic strip and results in excessive thickness.

the tolerances on tube neck diameter require that the length of the magnetic strip is shorter than the upper limit of neck circumference, which avoids the unwanted overlapping but results in a gap with no magnetizable material.

The magnetization device usually consists of a ring of coils introduced coaxially to the tube neck and located in contact with the strip to be magnetized. Excess thickness can prevent location or may cause tearing of the strip during the positioning of the magnetization device. When positioned coaxially, any excess thickness may space the magnetization device from the strip and prevent good contact with the periphery. This variation in contact will result in improper magnetization of the strip. The goal of the present invention is to describe a static convergence and/or purity device which can be substituted for the device described in current technology without the previously mentioned disadvantages.

SUMMARY OF THE INVENTION

This invention enables the control of the electron beam position within a picture tube. Control is achieved by the use of a magnetized strip which is formed into a ring around the neck and secured by an adhesive film. In this invention the strip has at least one end tapered in thickness for preventing any increase in thickness at the ring overlap.

In implementing an aspect of the invention, the strip ends are overlapped to provide a continuous ring of magnetic medium for optimum control capability.

BRIEF DESCRIPTION OF THE DRAWINGS

FIG. 1 is an illustration of a cathode ray tube. The static convergence and purity adjustment device can be seen on its neck;

FIG. 2A shows a front view of the convergence and purity control device which is wrapped around the tube neck and is prior art;

FIG. 2B shows a section of this same device following a perpendicular plane on its surface and parallel to its greatest length;

DETAILED DESCRIPTION

Figure 3A:
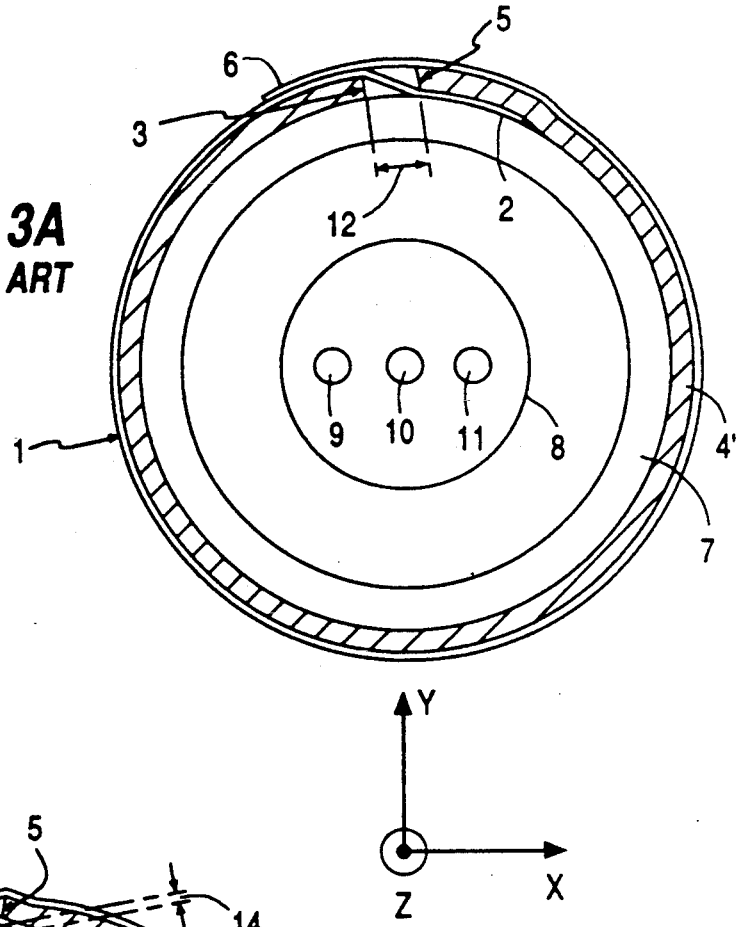
FIG. 3A PRIOR ART
FIG. 3A and 3B show a cross section of the static convergence and purity control device wrapped around the tube neck, as described in prior art, and displaying the defects this invention is designed to resolve.

FIG. 1, a flexible strip 4 of magnetizable material is wrapped around the neck 7 of the cathode ray tube 40 at the system level 8 of the three on-line guns located in the XZ plane perpendicular to the tube screen 42. As illustrated on this figure, the tube 40 has an electromagnetic deflection device 43 that follows the X horizontal axis and Y vertical axis of the electron beams 44 emitted by the electron guns 8 and a perforated metal mask or grid 41 used to permit each beam to excite only one of the color phosphors placed on the tube screen 42.

FIGS. 2A and 2B show a control device 1 described by previous techniques. This device consists of a flexible magnetic material strip 4', ferrite powder, for example, contained in a plastic material. This strip is placed on the adhesive surface of a piece of non-magnetic tape which is greater in length than the strip resulting in two extremities 2 and 6 which used to attach the strip to the tube neck. The ends of the strip, 3 and 5 are cut at right angles to the strip and are positioned parallel to the tube axis.

Figure 3B:
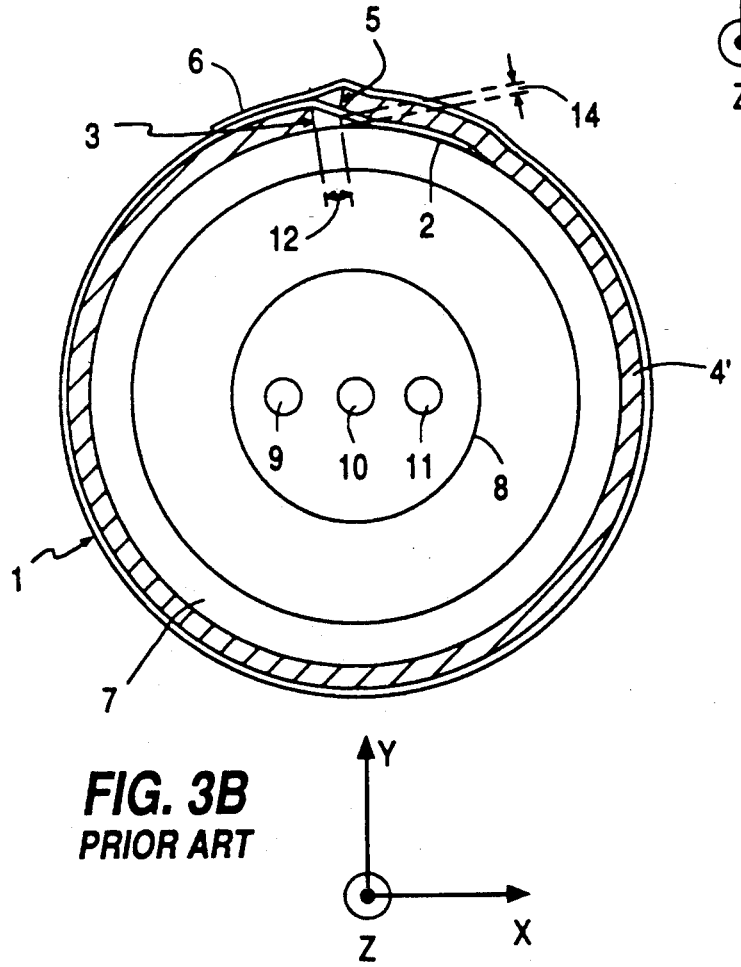
FIG. 3B PRIOR ART

FIGS. 3A and 3B, show the strip 4' wrapped around the glass neck 7 of the tube at in-line gun 9, 10, 11 system 8 level. The length of the strip must be suitable for wrapping around neck 7 and still leave an gap 12 in order to avoid material overlap if the neck diameter 7 falls below the admitted dimensional tolerance.

The device 1 is wrapped around the tube neck as follows:

- adhesive part 2 is attached to the neck
- strip 4' is wrapped around the neck
- at end 5 of the strip, the adhesive 2 is crushed to make contact with the neck
- adhesive part 6 is attached to the starting point of the strip end after covering the gap 12 left free of magnetic material.

FIG. 3A shows the device positioned for magnetization. However, the resilience of the magnetic material, in addition to the tension produced by the adhesive tape 2 cause the extremity 5 of strip 4' to lift up as shown in FIG. 3B, thus producing excess thickness 14.

The present invention eliminates the tape uplift caused by tension due to the crushing of part 2 by extremity 5. One embodiement of the invention has at least one of the extremities 3 and 5 shown in FIG. 3A, is bevel shaped. In an inventive embodiment shown in FIG. 4, one extremity 13, is bevel shaped and is applied to the tube neck, with the acute angle of the bevel located inside the encircling ring formed by strip 4. A further inventive embodiment is shown in FIG. 5, where the second extremity which is unbeveled is applied to the neck 7 and the acute angle of the beveled extremity is located at the closure of the encircling ring composed by strip 4.

Figure 4:
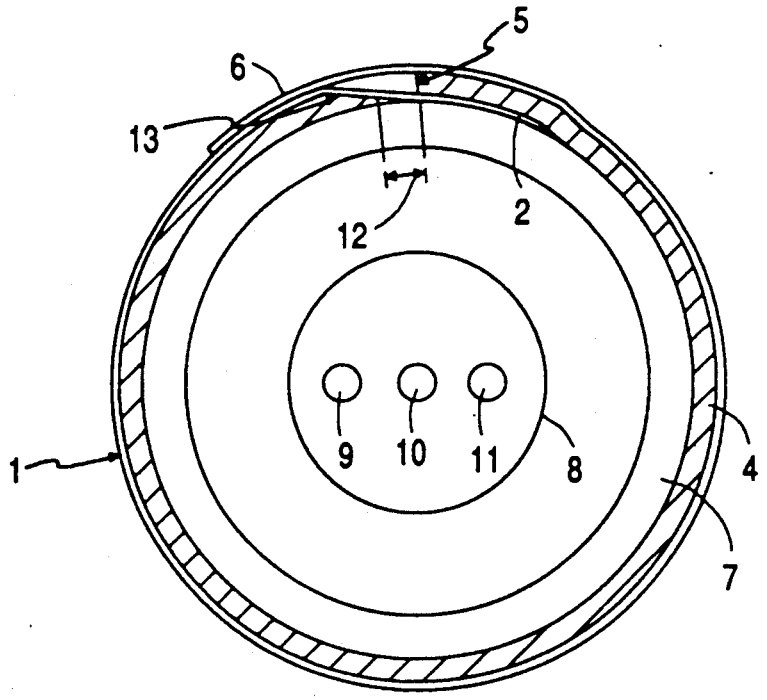
FIGS. 4 and 5 show cross section views of static convergence control and purity devices based on the present invention which do not produce excess local thickness.

FIG. 4 shows, that with the same strip length 4 as in current techniques, the bevel shape of the extremity 13 allows, the adhesive tape extremity 2 to be attached almost tangentially to the neck 7 at the point where the tape remaining extremity 6 is attached. This method eliminates the compression of extremity 2 and will prevent the uplift of extremity 5.

Figure 5:
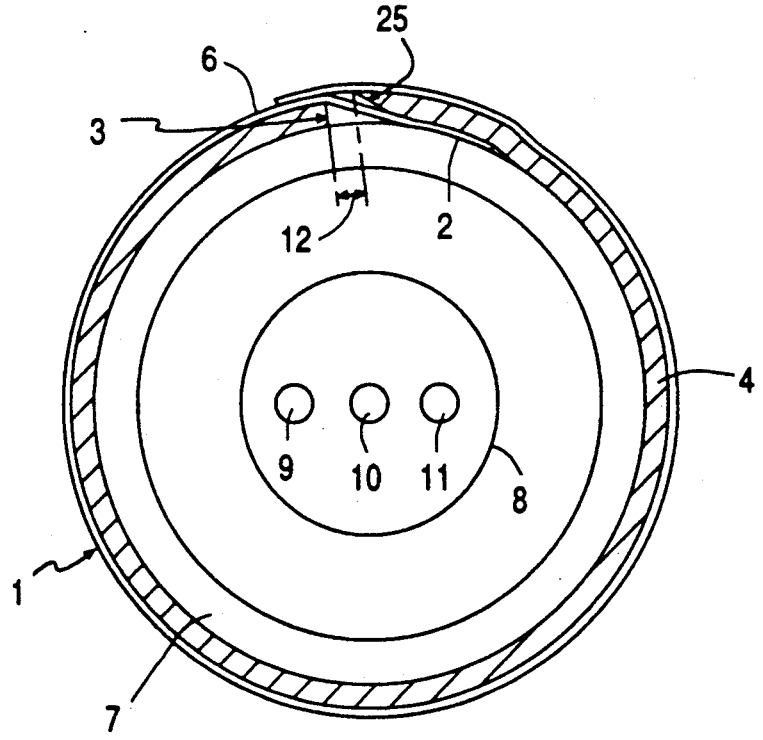

In FIG. 5, the bevel shaped extremity 25 allows the latter to press on extremity 2 of the adhesive tape without exerting pressure which has a tendency to lift up extremity 25 and create excess thickness. However, to avoid any overlapping of strip 4 extremities, the strip length must be less than tube neck's 7 external perimeter. A gap 12 is produced in the magnetic material, which cannot be magnetized to generate the required correcting magnetic field. This lack of correcting field may result in imperfect electron beam correction.

For optimum correction capability the magnetizable ring shaped strip 4 must be free of gaps. This is achieved in the present invention by a magnetizable material strip designed to encircle the tube neck. The strip extremities FIG. 6A 33/35 are parallel with the Z axis of the tube and will overlap without increasing radial space requirements.

Figure 6A:
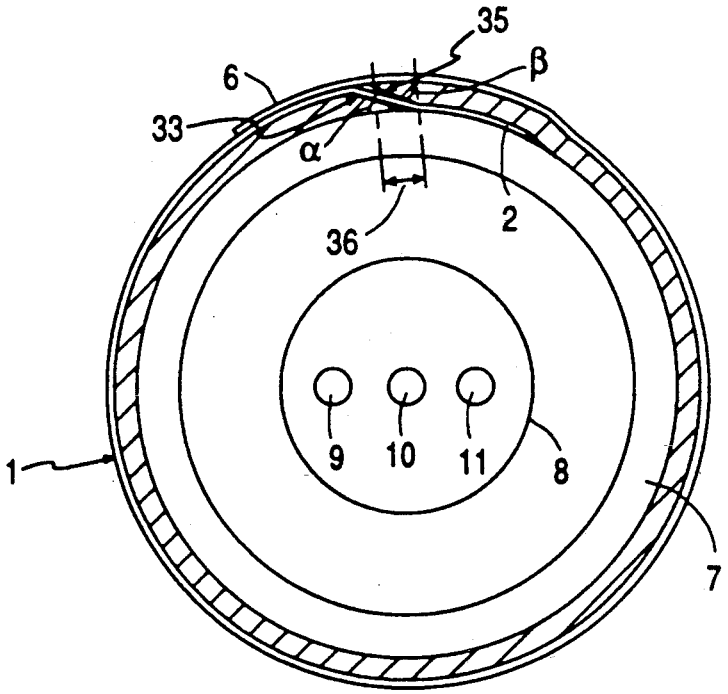
FIGS. 6A and 6B show cross section views of devices based on the present invention, where the strip ends overlap without producing excess thickness.
Figure 6B:
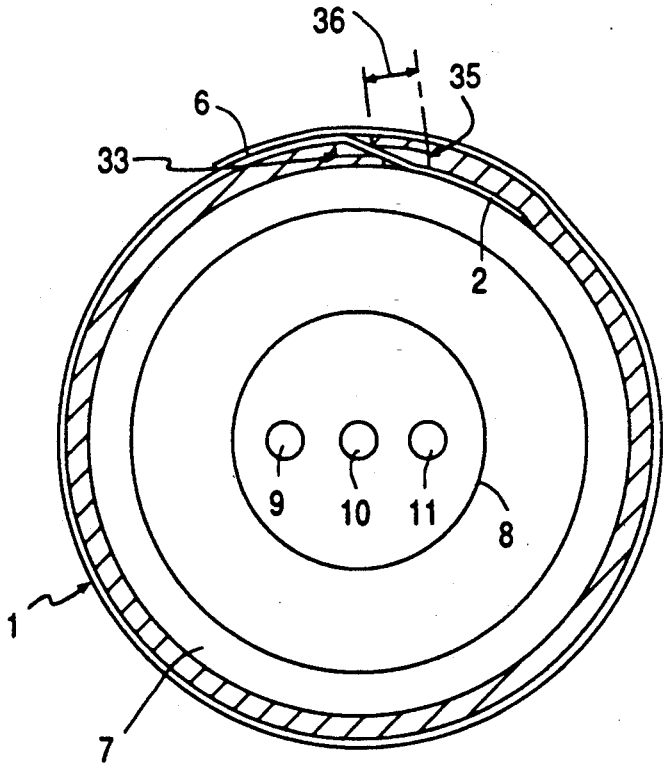

FIGS. 6A and 6B give two examples of a device based on the invention. FIG. 6A, shows an overlap produced without excess thickening by bevel cutting the two extremities 33 and 35 of strip 4 which is parallel to the Z axis of the tube. The strip is attached to the tube with the adhesive film 1 such that acute extremity of bevel 33 is the first part of the magnetic strip to contact the tube and becomes the start point in the formation of the ring. Extremities 33 and 35 will overlap and cover by elongation 36 strip 4, equal to the length of the bevelled part of extremity 35.

FIG. 6B shows a variant of extremities 33 and 35 where the thickness varies in a step rather than progressively.

The shapes of extremities 33 and 35 as shown in FIGS. 6A and 6B, do not exert any force on the adhesive tape section 2 which prevents possible uplifting of extremity 35. In addition the tapered thickness of the extremities imparts an extra flexibility to extremity 35 which produces a more consistent thickness of magnetic material forming the ring comprised of strip 4.

FIG. 6A shows the preffered embodiment, where the magnetizable material strip 4 has the following characteristics:

length of 111±0.3 mm
width of 25.4±0.5 mm
thickness of 3±0.03 mm

The strip is formed into a ring on a tube with an external neck diameter of 32.8 mm.

Extremity bevels 33 and 35 have acute angles a and $\beta$ of 30°.

These angle values depend on the tube neck's external diameter and the thickness of the magnetizable material strip 4. With a constant thickness, these angles increase when tube diameter diminishes and with constant tube diameter, they increase when strip 4 thickness increases.

What is claimed is:

1. A device to control electron beam position in a picture tube, comprising:
   a picture tube with neck and electron gun;
   a flexible magnetizable strip having two ends;
   an adhesive tape having two ends, said strip being adhered to the tape such that said tape ends extend beyond said strip ends, said tape and strip encircling said neck, with said strip contacting said neck and a first of the two tape ends attached to said neck and the second tape end completing said encirclement; and
   said strip further comprising at least one of the two ends tapered in thickness to support at least one of said two tape ends and provide a smooth completion of said encirclement.

2. A device as described in claim 1 where the tapered end thickness is bevel shaped.

3. A device as described in claim 2 wherein said bevel shaped end is the starting point of the neck encirclement.

4. A device as described in claim 2 wherein a second bevel shaped end completes the neck encirclement.

5. A device as described in claim 1 wherein said strip end has a step shaped taper.

6. A device to control electron beam position in a picture tube, comprising:
   a tube with neck and electron gun;
   a flexible magnetizable strip having two ends and being magnetized for electron beam control;
   an adhesive tape having two ends, said strip being adhered to the tape such that said tape ends extend beyond said strip ends, said tape and strip encircle said neck, with said strip contacting said neck and a first of the two tape ends attached to said neck and the second tape end completing said encirclement; and
   said strip further comprising at least one of the two ends tapered in thickness to smoothly overlap without any significant increase in overlap thickness as said strip encircles said neck and to provide a gapless magnetic medium.

7. A device as described in claim 6 where the tapered end thickness is bevel shaped.

8. A device as described in claim 6 wherein said strip end has a step shaped taper.

* * * * *